US009695591B2

(12) United States Patent
Mochizuki et al.

(10) Patent No.: US 9,695,591 B2
(45) Date of Patent: Jul. 4, 2017

(54) BEAM REINFORCING STRUCTURE

(71) Applicant: SENQCIA CORPORATION, Tokyo (JP)

(72) Inventors: Hisatomo Mochizuki, Tokyo (JP); Takuya Aoki, Funabashi (JP); Hidenori Tanaka, Funabashi (JP)

(73) Assignee: SENQCIA CORPORATION, Tokyo (JP)

( * ) Notice: Subject to any disclaimer, the term of this patent is extended or adjusted under 35 U.S.C. 154(b) by 0 days.

(21) Appl. No.: 14/753,821

(22) Filed: Jun. 29, 2015

(65) Prior Publication Data

US 2016/0002926 A1 Jan. 7, 2016

(30) Foreign Application Priority Data

Jul. 1, 2014 (JP) ..... 2014-135710

(51) Int. Cl.
*E04C 3/08* (2006.01)
*E04G 23/02* (2006.01)
(Continued)

(52) U.S. Cl.
CPC ..... *E04C 3/08* (2013.01); *E04C 3/083* (2013.01); *E04G 23/0244* (2013.01);
(Continued)

(58) Field of Classification Search
CPC .. E04C 2/425; E04C 2/423; E04C 2003/0452; E04C 3/065; E04C 3/08
See application file for complete search history.

(56) References Cited

U.S. PATENT DOCUMENTS 2,452,410 A * 10/1948 Wiegel ..... B25H 3/003 211/60.1
3,101,272 A 8/1963 Selzer
(Continued)

FOREIGN PATENT DOCUMENTS

JP 2003-193619 A 7/2003
JP 2007162244 A * 6/2007
(Continued)

OTHER PUBLICATIONS

May 5, 2016 Office Action issued in U.S. Appl. No. 14/753,702.
Sep. 30, 2016 Office Action issued in U.S. Appl. No. 14/753,702.
Jan. 5, 2017 Office Action issued in U.S. Appl. No. 14/753,702.

*Primary Examiner* — Brian Glessner
*Assistant Examiner* — Omar Hijaz
(74) *Attorney, Agent, or Firm* — Oliff PLC

(57) ABSTRACT

A beam is an H-shaped steel having flange parts above and under a web part. A through hole is formed on web part to let pipes and the like pass through. A ring beam reinforcing metallic material is disposed through hole. A beam reinforcing metallic material is disposed along the upper and lower flange parts at positions away from the through hole. The beam reinforcing metallic material on the front surface of the web part (opposite side of a flange of the ring beam reinforcing metallic material). The beam reinforcing metallic material in a direction in which a counter-flange surface of the beam reinforcing metallic material faces the flange part. A contacting surface is in contact with web part and is fixed to the web part with a welded section. At this time, the welded section is formed up to the height to which an angle varying part is covered.

5 Claims, 17 Drawing Sheets

(51) Int. Cl.
*E04C 3/04* (2006.01)
*E04C 3/06* (2006.01)
*E04C 2/42* (2006.01)

(52) U.S. Cl.
CPC ..... *E04C 2/423* (2013.01); *E04C 2/425* (2013.01); *E04C 3/065* (2013.01); *E04C 2003/0452* (2013.01)

(56) References Cited

U.S. PATENT DOCUMENTS

| | | | | |
|---|---|---|---|---|
| 3,123,978 | A | 3/1964 | Pruyn | |
| 3,126,709 | A | 3/1964 | Dougherty | |
| 3,890,757 | A | 6/1975 | Lamer et al. | |
| 4,003,168 | A | 1/1977 | Brady | |
| 4,129,974 | A | 12/1978 | Ojalvo | |
| 5,519,977 | A * | 5/1996 | Callahan | E04B 5/48 52/712 |
| 6,691,487 | B2 * | 2/2004 | Daudet | E04B 1/2403 174/480 |
| 7,293,394 | B2 * | 11/2007 | Davis | E04C 3/18 52/650.1 |
| 2005/0144892 | A1 * | 7/2005 | Strickland | B21D 47/01 52/837 |
| 2009/0148660 | A1 * | 6/2009 | Cooper | C09K 21/00 428/137 |

FOREIGN PATENT DOCUMENTS

| | | | |
|---|---|---|---|
| JP | 2009-167615 | A | 7/2009 |
| JP | 2011063931 | A * | 3/2011 |
| JP | 2013014956 | A * | 1/2013 |

* cited by examiner

BEAM REINFORCING STRUCTURE

TECHNICAL FIELD OF THE INVENTION

This invention relates to a beam reinforcing structure in which a beam reinforcing metallic material is connected to a beam constituting a building structure and having a through hole.

BACKGROUND OF THE INVENTION

It is conventional to form a through hole in a beam of a building structure to let pipes and wires to pass through the beam. In such cases, the flexural strength of the beam decreases because of the through hole. To prevent this decrease in the flexural strength of the beam, a beam reinforcing metallic material is connected to the beam, reinforcing the same.

As such a beam reinforcing metallic material, for example, there is a beam reinforcing metallic material that is a ring-shaped member connected to a through hole formed on a beam. (Patent Document 1 for example).

RELATED ART

Patent Documents

[Patent Document 1] Japanese Unexamined Patent Application Publication No. 2009-167615 (JP-A-2009-167615)

SUMMARY OF THE INVENTION

Problems to be Solved by the Invention

However, in order to securely obtain the flexural strength of the beam using only a ring-shaped beam reinforcing metallic material such as in Patent Document 1, a beam reinforcing metallic material of a large size may be required. The increase in size of the beam reinforcing metallic material leads to an increase in weight, which deteriorates handling properties, and also to an increase in amount of welding, which requires work-hours of welding operation.

The present invention was achieved in view of such problems. Its object is to provide a beam reinforcing structure that can efficiently reinforce a beam.

Means for Solving Problems

To achieve the above object, the present invention is a beam reinforcing structure using a beam reinforcing metallic material. The beam reinforcing structure comprises a beam having a through hole formed on a web thereof, a ring-shaped ring beam reinforcing metallic material that is fixed on the periphery or the edge part of the through hole, a pair of beam reinforcing metallic materials that are fixed in the vicinity of each of flange parts of the beam that are above and under the ring beam reinforcing metallic material.

The beam reinforcing metallic material comprises a contacting surface that contacts the web of the beam, a welding surface that is welded to the web, and a counter-flange-part surface that approximately faces the welding surface and faces the flange part of the beam, wherein the cross-section of the center part in longitudinal direction is larger than the cross-sections of the both end parts.

It is preferable that the counter-flange-part surface is approximately in a straight line to the longitudinal direction, the welding surface is bent or curved, and the width of the center part in the longitudinal direction is larger than the widths of the both end parts.

A mark that shows the direction of the counter-flange-part surface may be provided.

The mark may be a protrusion provided on the counter-flange-part surface.

The protrusion may be formed up to the edge part of the contacting surface and the beam reinforcing metallic material may be fixed to the position in which the tip of the protrusion is located at the thickness varying part of the web, which is in the vicinity of the border part between the web and the flange part. Or, the protrusion may not be formed up to the edge part of the contacting surface and a gap may be formed between the lower edge of the protrusion and the edge part of the contacting surface so that the tip of the protrusion is in contact with the flange part.

A welding-range specifying part that specifies a range of welding may be provided on the welding surface that is welded up to the position in which the welding-range specifying part is covered. The welding-range specifying part may be an angle-varying part on the cross-section in the width-direction.

According to the present invention, since a ring beam reinforcing metallic material is used together with a pair of block-shaped beam reinforcing metallic materials, downsizing of the ring beam reinforcing metallic material can be achieved in comparison to the conventional reinforcement using only a ring beam reinforcing metallic material. Therefore, it is possible to reduce both the total weight of the members in use and the total amount of welding.

Also, since the beam reinforcing metallic material has a varying cross sectional shape in which the cross sectional area at the center part is large, it is possible to efficiently reinforce only the part that requires the most flexural strength and, also, weight-reduction can be achieved. Also, since the cross-sectional area (thickness for example) of the required part is large, the entire size (installation area) can be reduced. Therefore, it is even possible to install the beam reinforcing metallic material in a part in which the gap between the through hole and the flange part is small.

Also, bending or curving the welding surface of the beam reinforcing metallic material so to enlarge the width of the center part makes it easier to weld compared to the cases in which a simple rectangular shape is used. For example, if a rectangular plate member is used, it is necessary to weld all four sides of the plate. However, in the present invention, welding only three sides of the beam reinforcing metallic material is sufficient and welding operation is easy since the three sides do not interchange to one another but are smoothly continuous so that the difference in welding direction depending on the parts is small.

Also, providing a mark showing the direction of the counter-flange-part surface makes it impossible to mistake the installing direction or the installing surface of the beam reinforcing metallic material. On this occasion, visibility is excellent if the mark is a protrusion, and the contacting surface is not mistakenly disposed in place of the counter-flange-part surface.

Also, if the protrusion is formed up to the edge part of the contacting surface (in other words, if the protrusion is formed over the whole height of the counter-flange-part surface), the lower edge of the protrusion can be butted to the fillet shaped edge part on the boundary between the web part and the flange part. Therefore, the beam reinforcing metallic material can be installed at a predetermined distance from the fillet-shaped edge part. This facilitates the positioning of the beam reinforcing metallic material.

Also, if the protrusion is not formed up to the edge part of the contacting surface and a gap is formed between the lower edge of the protrusion and the edge part of the contacting surface (in other words, if the protrusion is formed from the upper part to the middle of the counter-flange-part surface), the protrusion can be butted to the flange part with the lower end of the protrusion not interfering with the fillet shape on the boundary between the web part and the flange part. Therefore, the beam reinforcing metallic material can be installed at a predetermined distance from the flange part without an influence of the fillet shape. This facilitates the positioning of the beam reinforcing metallic material.

Also, providing a welding-range specifying part on the welding surface showing the welding range makes it easy to grasp the necessary welding margin. Therefore, it is possible to suppress unnecessary welding as well as to prevent insufficient welding and the like.

Effects of the Invention

The present invention can provide a beam reinforcing structure that can efficiently reinforce a beam.

BRIEF DESCRIPTION OF DRAWINGS

FIG. 3(*b*) is a plan view showing the beam reinforcing metallic material 1.

FIG. 4(*b*) is a cross sectional view of D-D line in FIG. 3(*b*).

FIG. 6(*b*) is a perspective view showing the back side of a beam reinforcing structure 20.

FIG. 17(*b*) shows the difference in weight between the present invention and the comparative example.

DESCRIPTION OF SOME EMBODIMENTS

Figure 1:
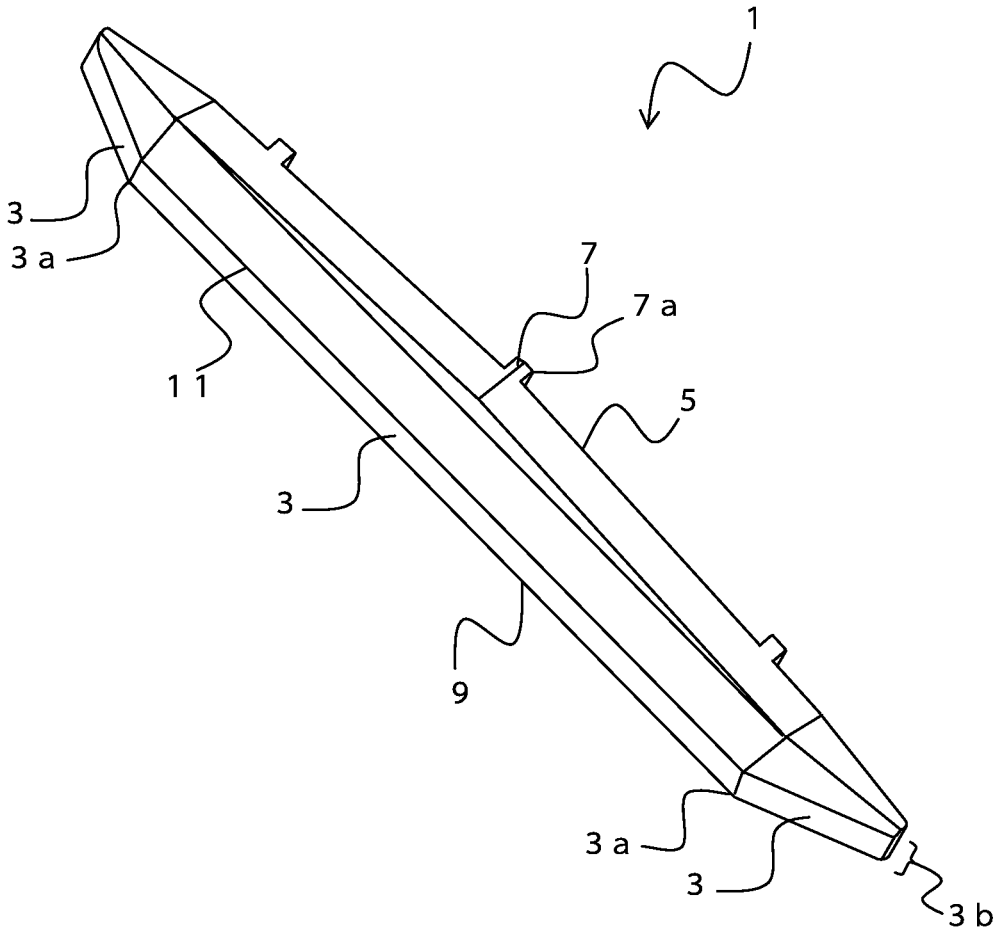
FIG. 1 is an upper perspective view showing a beam reinforcing metallic material 1.
Figure 2:
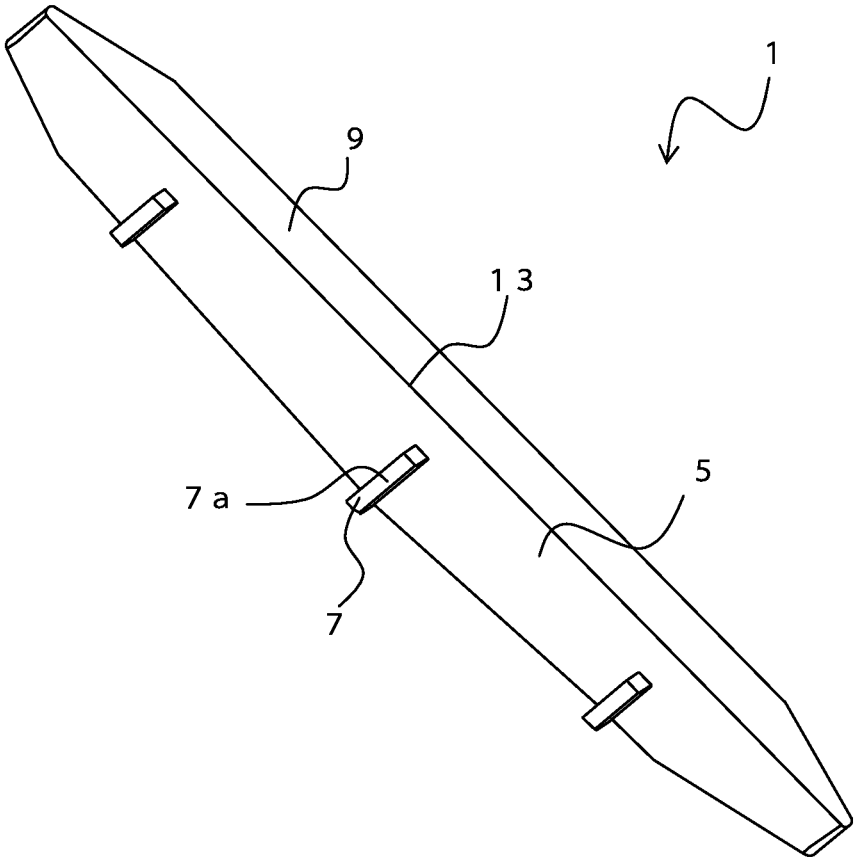
FIG. 2 is a lower perspective view showing the beam reinforcing metallic material 1.
Figure 3:
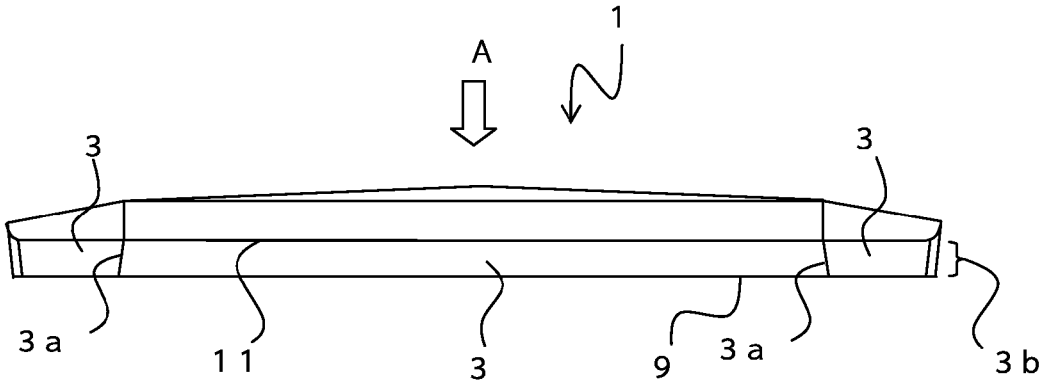
FIG. 3(*a*) is a front view showing the beam reinforcing metallic material 1.
Figure 3:
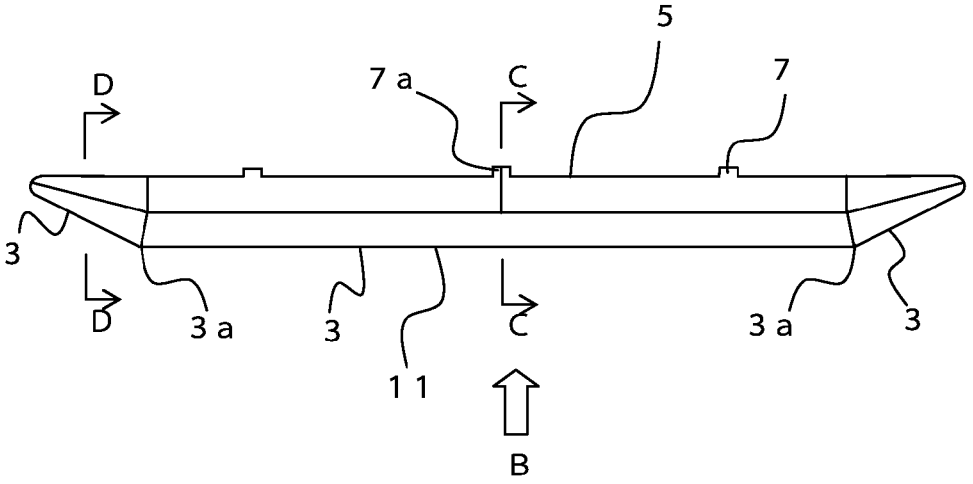

Hereinafter, an embodiment of the present invention will be described. FIG. 1 is an upper perspective view and FIG. 2 is a lower perspective view showing the beam reinforcing metallic material 1. FIG. 3(*a*) is a front view showing the beam reinforcing metallic material 1 (a view from arrow B in FIG. 3(*b*)) and FIG. 3(*b*) is a plan view showing the beam reinforcing metallic material 1 (a view from arrow A in FIG. 3(*a*)).

The beam reinforcing metallic material 1 has a welding surface 3, a counter-flange-part surface 5, a contacting surface 9, protrusions 7, and the like. The beam reinforcing metallic material 1 is a member made of metal such as steel materials and stainless steel. The beam reinforcing metallic material 1 is not plate shaped but has a three dimensional shape. More particularly, the cross-sectional shape preferably varies from the edge parts toward the center part in the longitudinal direction. Details of the cross-sectional shapes will be described later.

The contacting surface 9 is a surface that contacts a web part of a beam. Therefore, the contacting surface 9 is formed to be a perfectly flat surface.

The counter-flange-part surface 5 is a part that faces a flange part of a beam and is formed in an approximately straight line. The protrusion 7 is formed on the counter-flange-part surface. Although the beam reinforcing metallic material 1 with total of three protrusions 7, of which the one is formed at the center in the longitudinal direction and the other two are formed on both sides thereof, is shown in the example drawings, the location and the number of the protrusions 7 are not limited to the examples shown.

The protrusion 7 functions as a mark 7*a* showing the direction of the counter-flange-part surface 5. For example, if no mark 7*a* such as the protrusion 7 is formed, it is possible that the counter-flange-part surface 5 is mistakenly taken as the contacting surface 9 that is to be in contact with a web. It is also likely to dispose the counter-flange-part surface 5 in the direction opposite to the flange part. Providing the protrusion 7 clarifies that the protrusion 7 is to be disposed toward the direction of the flange part, thus preventing mistakes in installation.

If the protrusion 7 is formed at least at the center in the longitudinal direction, the center protrusion 7 can be used to grasp the center position of the beam reinforcing metallic material 1. Therefore, it is possible to easily grasp the installation position of the beam reinforcing metallic material 1 against the through hole in its longitudinal direction.

The mark to grasp the directions and the like of the beam reinforcing metallic material 1 is not necessarily the protrusion 7. Other structures (such as dents, coloring, or marking-off) may be used as long as the direction can be grasped.

The welding surface 3 is a part that approximately faces the counter-flange part 5 and is welded to a web part of a beam. As shown in FIG. 3(*b*), the welding surface 3 has a bent section 3*a* in part. A curved section may be formed instead of the bent section 3*a* and even the whole welding surface 3 may be in a curved shape.

In the example shown in the drawing, the beam reinforcing metallic material 1 is substantially a trapezoid in a plan view. That is, the welding surface 3 is formed by three sides. Since the welding part may have only three sides in the present embodiment, it is unnecessary to weld over the whole circumference as in welding a plate-like member. In addition, the two sides on either sides of the welding surface 3 are not formed perpendicular to the center side of the welding surface 3 but are formed in gentle tapered shapes. Therefore, change in the welding direction is small, which makes the welding operation easy to perform.

Figure 4:
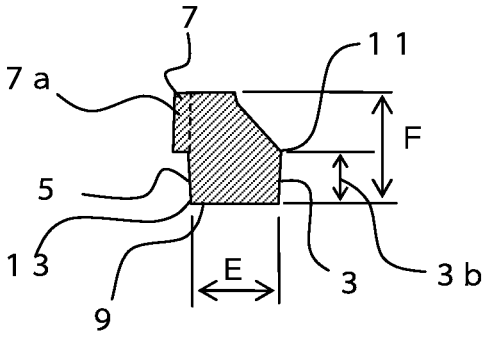
FIG. 4(*a*) is a cross sectional view of C-C line in FIG. 3(*b*).
Figure 4:
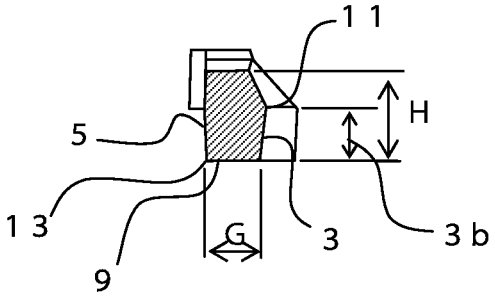

FIG. 4(*a*) is a cross-sectional view of C-C line in FIG. 3(*b*) (the vicinity of the center in longitudinal direction) and FIG. 4(*b*) is a cross-sectional view of D-D line in FIG. 3(*b*) (the vicinity of the end part in longitudinal direction). As described above, the beam reinforcing metallic material 1 has a cross-sectional shape that varies in longitudinal direction. Hereinafter in the descriptions below, the distance between the welding surface 3 and the counter-flange part surface 5 of the beam reinforcing metallic material 1 (the length of the contacting surface 9) is called as a width of the beam reinforcing metallic material 1, and the distance between the contacting surface 9 and the upper surface (the length of the counter-flange-part surface 5) is called as a height when the contacting surface 9 is a lower surface.

The cross section (cross-sectional area) of the center part in longitudinal direction of the beam reinforcing metallic material 1 is larger than the cross section (cross-sectional area) of the both end parts. More particularly, the width E of the center part in the longitudinal direction of the beam reinforcing metallic material 1 is larger than the width G of the both end parts. Also, the height F of the center part in longitudinal direction of the beam reinforcing metallic material 1 is larger than the height H of the both end parts.

Increasing the cross-sectional area of the vicinity of the center part of the beam reinforcing metallic material 1 allows the part that receives maximum stress when the beam reinforcing metallic material 1 is fixed to the beam to securely obtain the strength. Also, on this occasion, since the strength necessary for the beam reinforcing metallic material 1 decreases as leaving away from the center, making the cross section smaller toward the end parts corresponding to this can suppress the increase in weight and cost.

Here, the protrusion 7 is not formed over the whole height of the counter-flange-part surface 5, but is formed on a part thereof. More specifically, if a side on the border between the counter-flange-part surface 5 and the contacting surface 9 is an edge part of the contacting surface 13, the protrusion 7 is not formed from upper part of the counter-flange-part surface 5 to the edge part of the contacting surface 13 and a gap is formed between the lower end of the protrusion 7 and the edge part of the contacting surface 13.

Also, on the cross section of the beam reinforcing metallic material 1 in the width direction, an angle-varying part 11 is provided on the upper part of the welding surface 3. The angle-varying part 11 is a section in which an angle between the welding surface 3 and the upper part thereof varies on the cross section. The angle-varying part 11 functions as a welding-range specifying part 3*b*. That is, required welding strength can be securely obtained by welding up to the position to which the angle-varying part 11 is covered.

The welding-range specifying part 3*b* is not necessarily the angle-varying part 11, but may be other structures such as coloring, level difference, and roughness change.

Also, if the beam reinforcing metallic material 1 is manufactured by using metal mold in forging and the like, draft taper is necessary for pulling out from the metal mold and this draft taper can be used as the angle-varying part 11. For example, by setting the angle-varying part 11 to the fitting section of the mold, the angle-varying part 11 can be formed on the border between the draft taper of the lower part of the welding surface 3 and the opposite taper on the upper part thereof.

The ring beam reinforcing metallic material 30 is a ring member which is made of metal such as steel materials and stainless steel. The ring beam reinforcing metallic material 30 has a piping hole 37 through which pipes and the like pass. On one side of the ring beam reinforcing metallic material 30, a flange 33 is provided. The flange 33 has an outer diameter that is larger than that of the through hole provided on the beam. On the other side of the ring beam reinforcing metallic material 30, a cylindrical inserting section 35 having a smaller outer diameter than that of the flange 33 is provided. The inserting section 35 has a smaller outer diameter than the diameter of the through hole provided on the beam. The flange 33 is used for positioning the ring beam reinforcing metallic material 30 in axial direction when the ring beam reinforcing metallic material 30 is inserted into the through hole of the beam.

Figure 6:
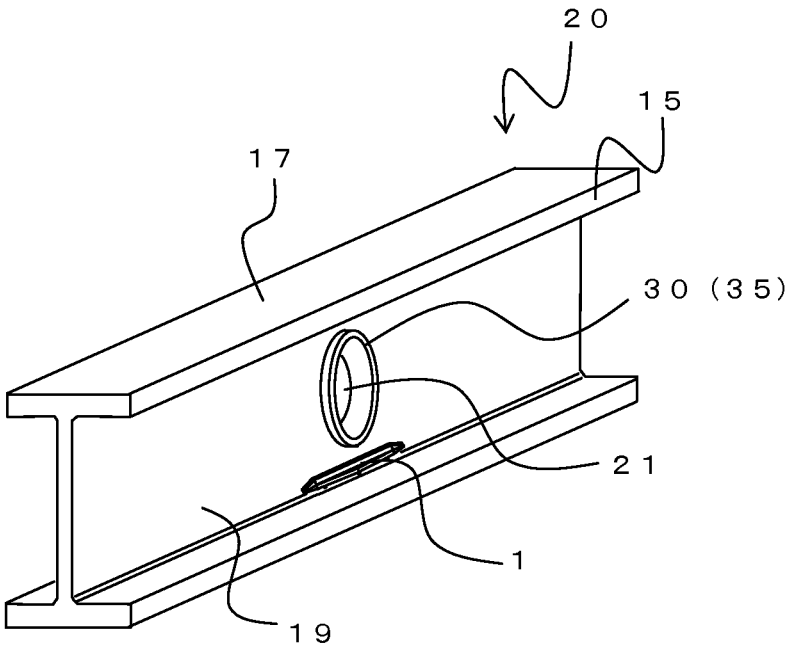
FIG. 6(*a*) is a perspective view showing the front side of a beam reinforcing structure 20.
Figure 6:
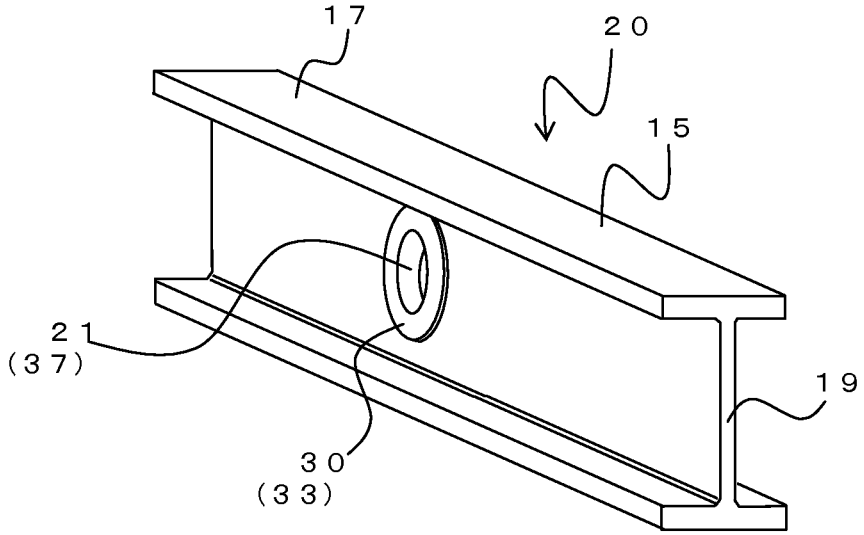

Next, a beam reinforcing structure 20 using the beam reinforcing metallic material 1 will be described. FIG. 6(*a*) is a perspective view of the front side, FIG. 6(*b*) is a perspective view of the back side, and FIG. 7 is a front view of the beam reinforcing structure 20.

A beam 15 is an H-shaped steel having flange parts 17 that are above and below a web part 19. A through hole 21 is formed in the web part 19 to let pipes and the like pass through. The ring beam reinforcing metallic material 30 is disposed at the through hole 21. Also, the beam reinforcing metallic materials 1 are disposed at positions away from the through hole 21, along the upper and lower flange parts 17. The center position of the through hole 21 is approximately corresponds with the center position of the beam reinforcing metallic material 1 in longitudinal direction. Also, the beam reinforcing metallic material 1 is longer than the diameter of the through hole 21.

Figure 7:
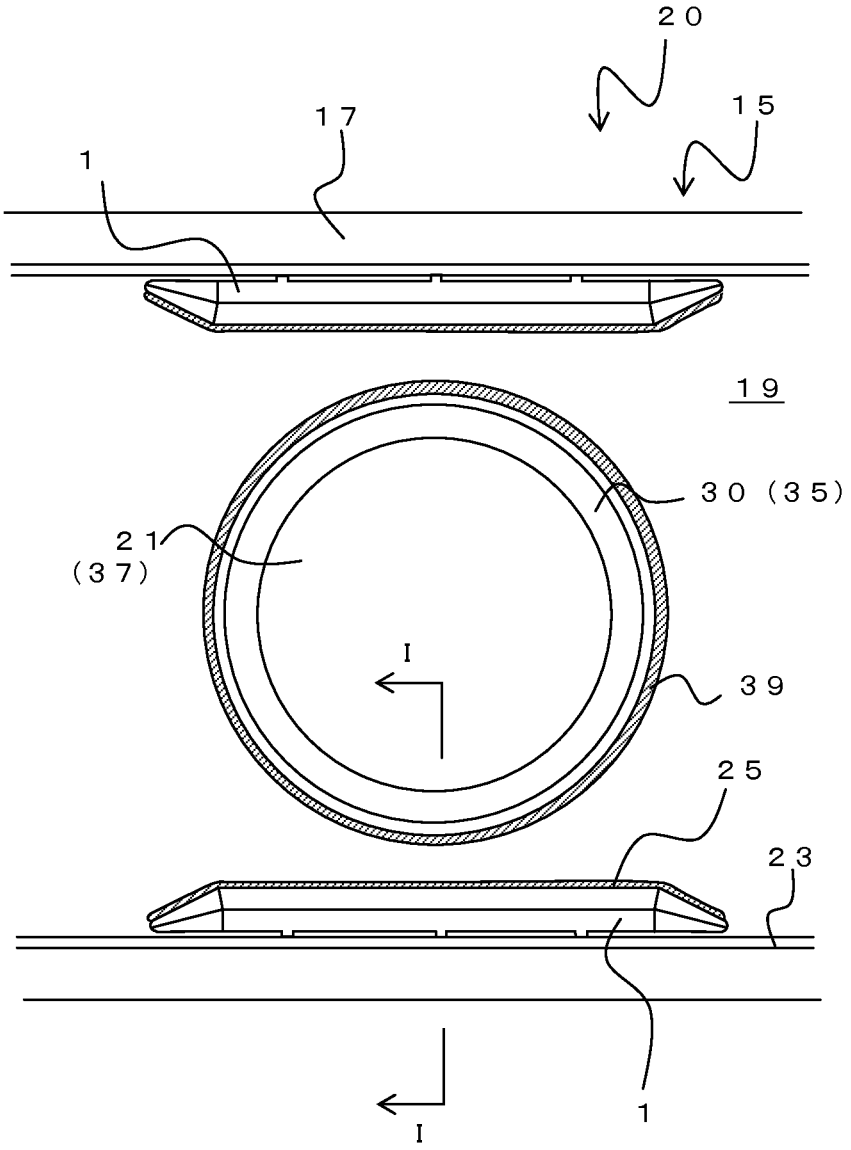
FIG. 7 is a front view showing the beam reinforcing structure 20.
Figure 8:
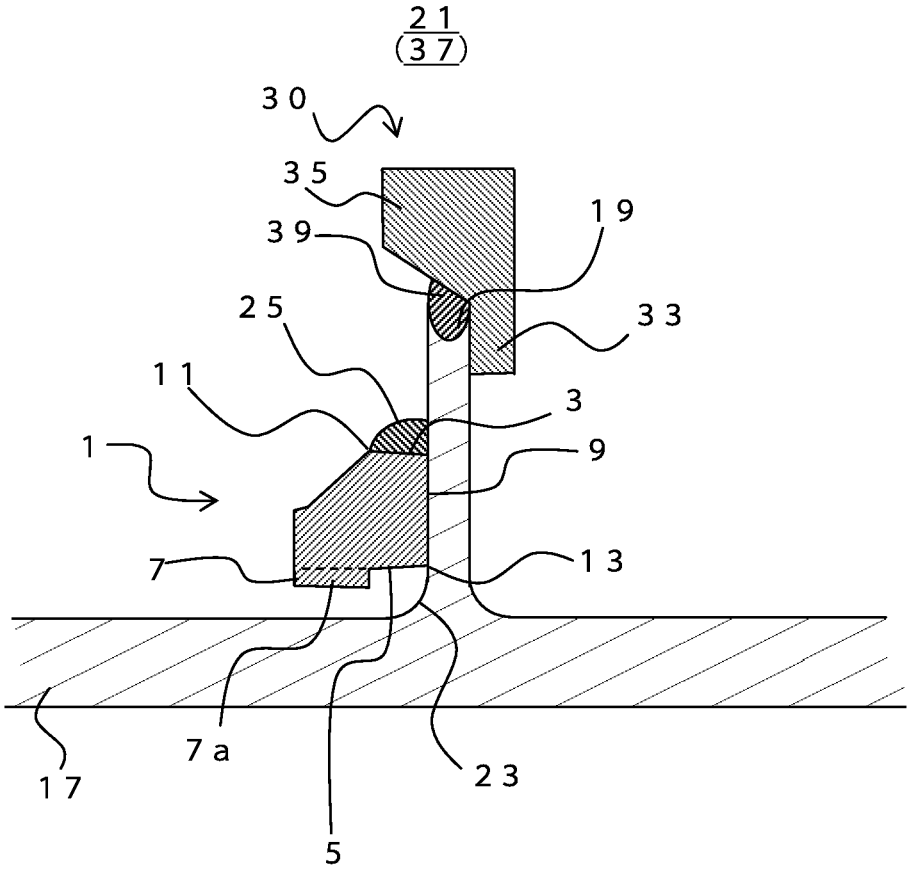
FIG. 8 is a cross sectional view of I-I line in FIG. 7.

FIG. 8 is a cross-sectional view of I-I line in FIG. 7. The ring beam reinforcing metallic material 30 is fixed at the periphery or the edge part of the through hole 21 by inserting the inserting section 35 from the back side of the web part 19 into the through hole 21. On this occasion, the inserting section 35 of the ring beam reinforcing metallic material 30 is inserted until the flange 33 comes into contact with the web part 19. With the flange 33 contacting the web part 19, the position of the ring beam reinforcing metallic material 30 to the web part 19 in axial direction can be decided accurately.

After the position of the ring beam reinforcing metallic material 30 is decided, the ring beam reinforcing metallic material 30 is temporary welded to the web part 19 by spot welding a few spots of the periphery part of the flange 33 to the web part 19 from the side of the flange 33. Then, the ring beam reinforcing metallic material 30 and the web part 19 are integrated by welding the whole circumference of the inserting section 35 from the side of the inserting section 35 with a welded section 39. The welding is performed by, for example, shielded metal arc welding. The ring beam reinforcing metallic material 30 can improve the flexural strength of the vicinity of the through hole 21.

The beam reinforcing metallic material 1 is disposed on the front side of the web part 19 (opposite side of the flange 33 of the ring beam reinforcing metallic material 30). Also, the beam reinforcing metallic material 1 is disposed in the direction in which the counter-flange-part surface 5 of the beam reinforcing metallic material 1 faces the flange part 17. Also, the contacting surface 9 contacts with the web part 19 and is fixed to the web part 19 by means of a welded section 25. On this occasion, the welded section 25 is formed up to the height to which the angle-varying part 11 is covered.

Here, a fillet section 23 is formed on the border part between the web part 19 and the flange part 17 of the beam 15. The fillet section 23, which is a thickness varying part of the web part 19, is an approximately arc-shaped concave section that gently connects the web part 19 and the flange part 17. There is a case in which a weld bead is formed instead of the fillet part 23, and in this case, its shape becomes an approximately arc-shaped convex shape. Although the fillet section 23 will be described below, it is also similar in the case of a welded section.

The effects of enhancing the flexural strength is larger if the beam reinforcing metallic material 1 is closer to the flange part 17. Therefore, the beam reinforcing metallic material 1 is disposed at a position that is away from the through hole 21 and in the vicinity of the flange part 17.

On the other hand, as described above, the fillet section 23 is formed in the vicinity of the border part between the web part 19 and the flange part 17. If the beam reinforcing metallic material 1 is over the fillet section 23, the beam reinforcing metallic material 1 rides over the fillet section 23 so that the contacting surface 9 may separate from the web part 19. Therefore, the beam reinforcing metallic material 1 is installed at a position in which the beam reinforcing metallic material 1 does not ride over the fillet section 23. That is, the beam reinforcing metallic material 1 is disposed at a position in which the edge part of the contacting surface 13 is disposed at the position which is further on the side of the through hole than the fillet section 23.

As described above, according to the present embodiment, the beam 15 having the through hole 21 can be efficiently reinforced. Particularly, by reinforcing the periphery of the through hole 21 with the ring beam reinforcing metallic material 30 and disposing the beam reinforcing metallic material 1 away from the through hole, the beam 15 can be efficiently reinforced.

Also, since the beam reinforcing metallic material 1 is formed so that the cross section of the center part thereof is large, the strength for the required part can be securely obtained as well as achieving weight reduction. Also, since sufficient strength can be secured by varying the thickness in this way without increasing the width, the installation is possible even the distance between the flange part 17 and the through hole 21 is small.

Also, it is unlikely to mistake the installation direction or the installation surface of the beam reinforcing metallic material 1 because the protrusion 7 that shows the direction of the counter-flange-part surface 5 is formed.

Also, since the welding surface is formed to be bent, the beam reinforcing metallic material 1 can be fixed to the web part 19 by welding the three sides. Therefore, welding operation is easy.

Also, since the welding range is specified by a welding range specifying part 3*b* which is the angle-varying part 11 it is possible to suppress insufficient welding and cost increase due to excessive welding.

Figure 9:
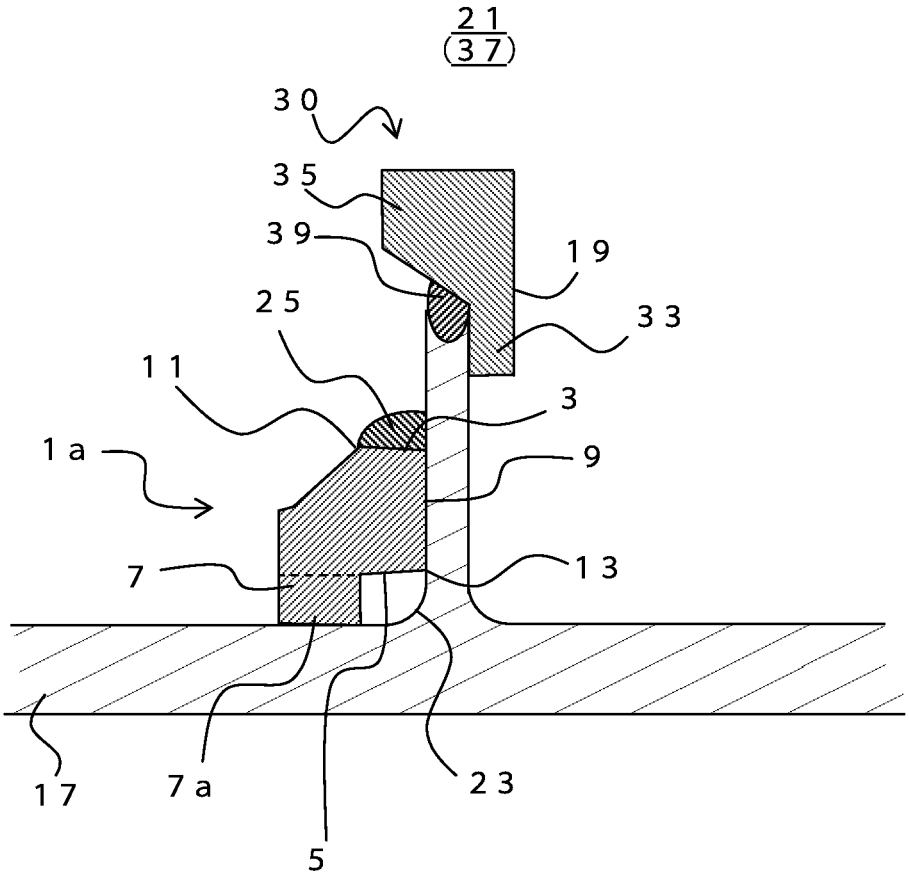
FIG. 9 is a cross sectional view showing a second embodiment.

Next, a second embodiment of the present invention will be described. FIG. 9 corresponds to FIG. 8 and shows a beam reinforcing structure according to the second embodiment having a beam reinforcing metallic material 1*a* disposed in place of the beam reinforcing metallic material 1. In the descriptions below, the same numerals as in FIG. 8 will be used for the same structures as in the beam reinforcing metallic material 1, and redundant explanations will be omitted.

The beam reinforcing metallic material 1*a* has almost the same structure as the beam reinforcing metallic material 1 except that the length of the protrusion 7 (protruded margin) is different. The protruded margin of the protrusion 7 of the beam reinforcing metallic material 1*a* is slightly larger than the range of the fillet section 23 formed. Therefore, to install the beam reinforcing metallic material la, the protrusion 7 is brought into contact with the flange part 17 so that the positioning of the beam reinforcing metallic material 1*a* can be easily decided. At this time, the beam reinforcing metallic material 1*a* does not ride over the fillet section 23.

The same effects can be obtained as the beam reinforcing metallic material 1 with the beam reinforcing metallic material la. Also, since the length of the protrusion 7 corresponds to the size of the fillet section 23, it is possible to position the beam reinforcing metallic material 1*a* with certainty by butting the protrusion 7 to the flange part 17. Therefore, workability of installation is excellent.

Figure 10:
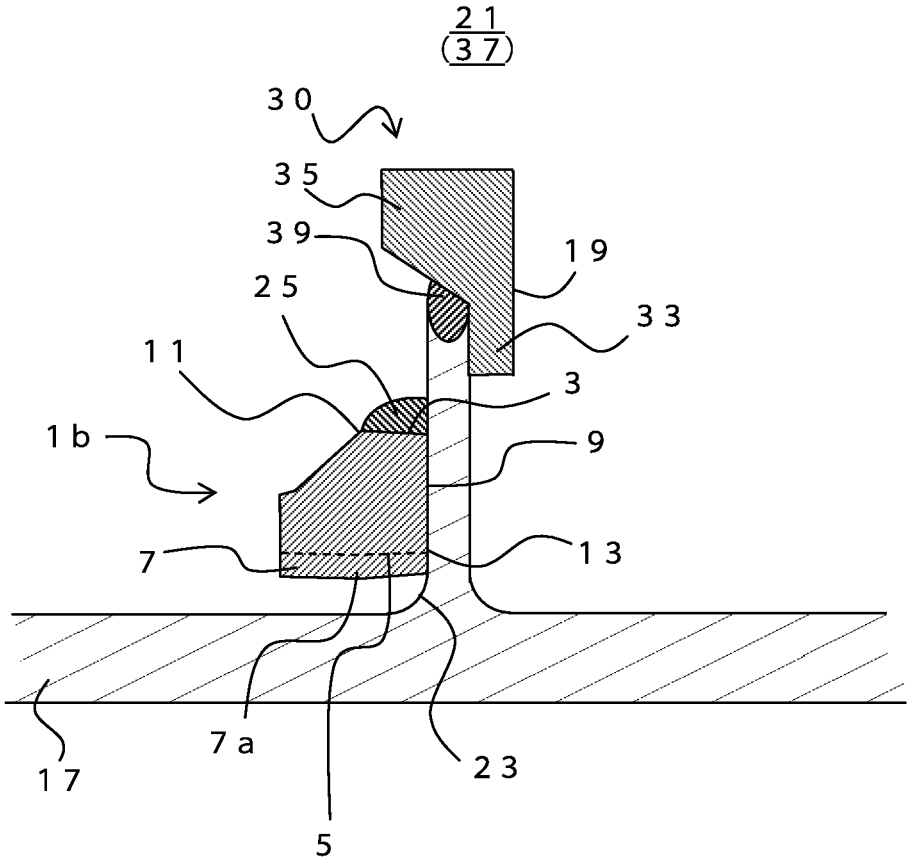
FIG. 10 is a cross sectional view showing a third embodiment.

FIG. 10 is a cross-sectional view of a beam reinforcing metallic material 1*b* according to a third embodiment of the present invention. The beam reinforcing metallic material 1*b* has almost the same structure as the beam reinforcing metallic material 1 except that the protrusion 7 is formed up to the edge part of the contacting surface 13.

To dispose the beam reinforcing metallic material 1*b*, the lower tip end of the protrusion 7 is disposed along the edge part of the fillet section 23. By disposing this way, the edge part of the contacting surface 13 is disposed at a predetermined distance (equivalent to the length of the protrusion 7) away from the fillet section 23. Therefore, the contacting surface 9 does not ride over the edge part of the contacting surface 13.

To dispose the tip of the protrusion 7 along the edge part of the fillet section 23, the beam reinforcing metallic material 1*b* is slid from the side of the through hole 21 until the tip of the protrusion 7 is butted to the fillet section 23 or may be adjusted by visual observation.

By doing this way, the beam reinforcing metallic material 1*b* can be disposed easily at a position which is a predetermined distance away from the fillet section 23. For example, there are cases in which the fillet section 23 is not perfectly straight, and, if the contacting surface 9 is disposed to be in contact with the fillet section 23, it is likely that a part of the beam reinforcing metallic material 1*b* rides over the fillet section 23. However, if the beam reinforcing metallic material 1*b* is away from the fillet section 23 with the predetermined distance, the influence from this can be eliminated. Also, chamfering the edge part of the protrusion 7 and the like can prevent the contacting surface 9 from rising even if the protrusion 7 rides slightly over the vicinity of the edge part of the fillet section 23.

Figure 5:
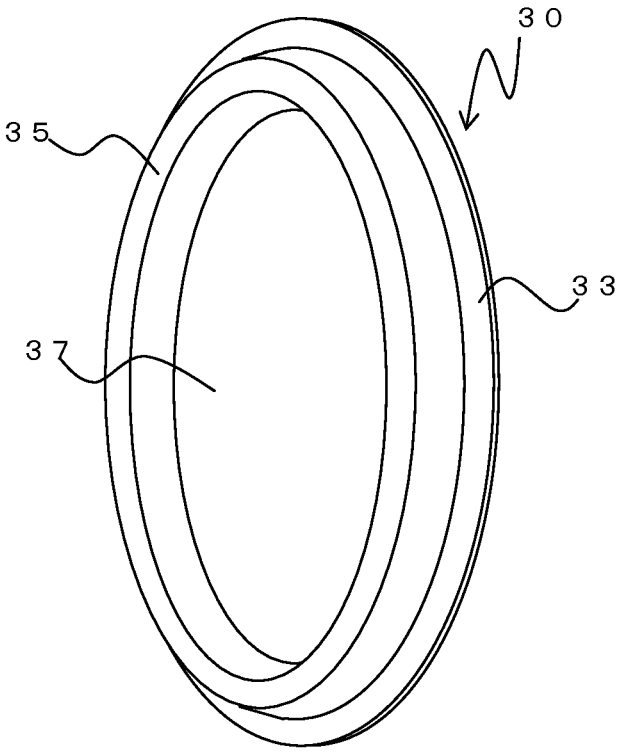
FIG. 5 is a perspective view showing a ring beam reinforcing metallic material 30.
Figure 11:
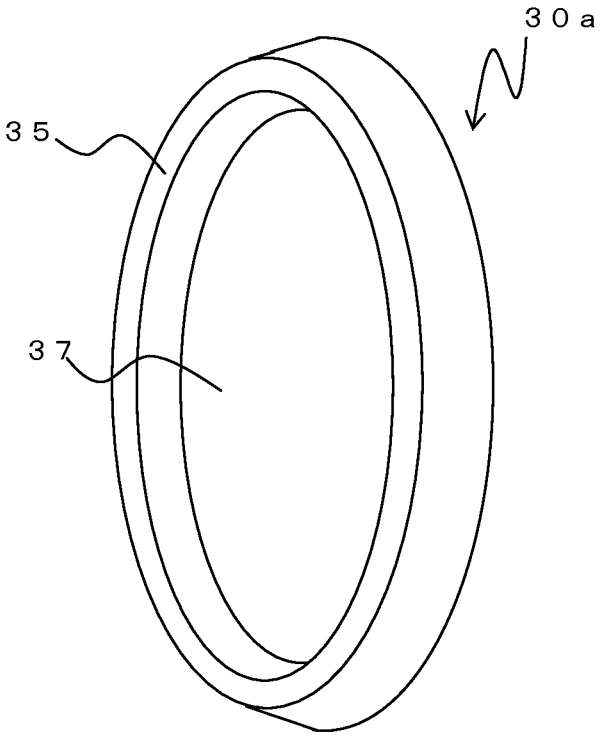
FIG. 11 is a perspective view showing a ring beam reinforcing metallic material 30*a*.

Also, in the present invention, the embodiments of the ring beam reinforcing metallic material are not limited to the examples shown in FIG. 5 and the like. FIG. 11 is a perspective view showing a second embodiment of a ring beam reinforcing metallic material 30*a*. The structure of the ring beam reinforcing metallic material 30*a* is almost the same as the ring beam reinforcing metallic material 30 except that the flange 33 is not formed.

The shape of the outer peripheral surface of the inserting section 35 of the ring beam reinforcing metallic material 30*a* is tapered. That is, the outer diameter of the ring beam reinforcing metallic material 30*a* gradually varies from one side toward the other side.

Figure 12:
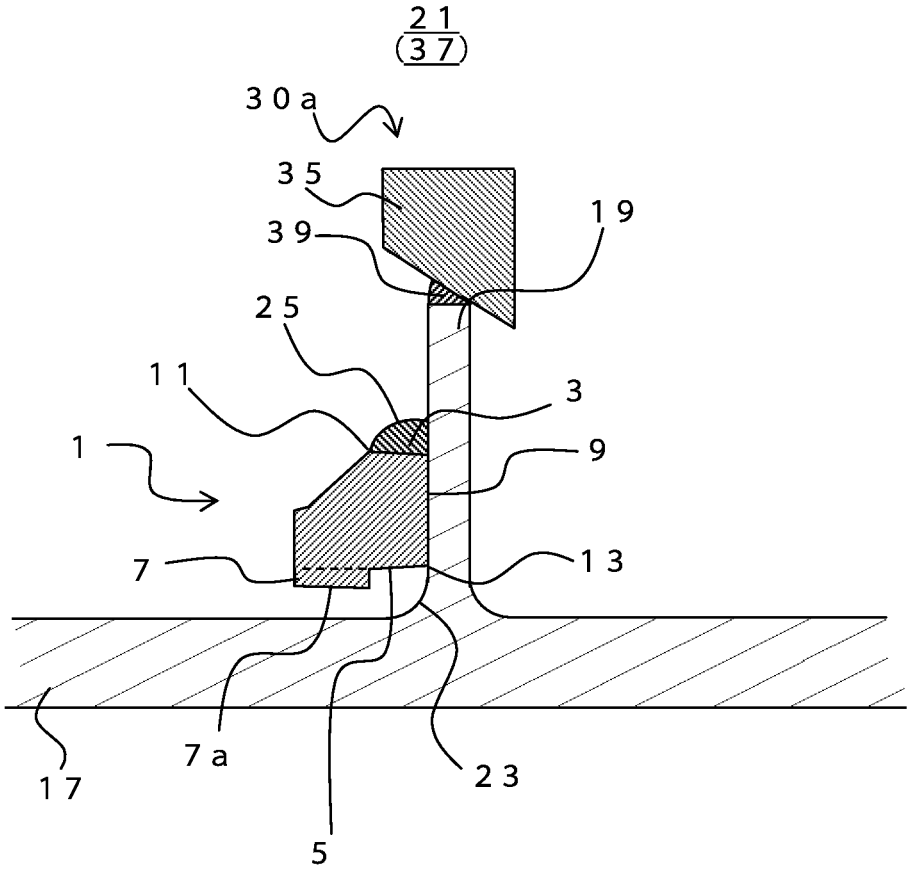
FIG. 12 is a drawing corresponding to FIG. 8 with the ring beam reinforcing metallic material 30*a*.

FIG. 12 is a cross-sectional view of a beam reinforcing structure using the ring beam reinforcing metallic material 30*a* and corresponds to FIG. 8. The ring beam reinforcing metallic material 30*a* is inserted from the back side of the web part 19 like the ring beam reinforcing metallic material 30. The ring beam reinforcing metallic material 30 is inserted until the flange 33 is in contact with the web part 19, whereas, in the present embodiment, the ring beam reinforcing metallic material 30*a* is inserted until the outer peripheral surface of the ring beam reinforcing metallic material 30*a* is in contact with the edge part of the through hole 21 (web part 19). In this way, the positioning of the ring beam reinforcing metallic material 30*a* in its axial direction is determined and the ring beam reinforcing metallic material 30*a* is fixed to the periphery or the edge part of the through hole 21.

Figure 13:
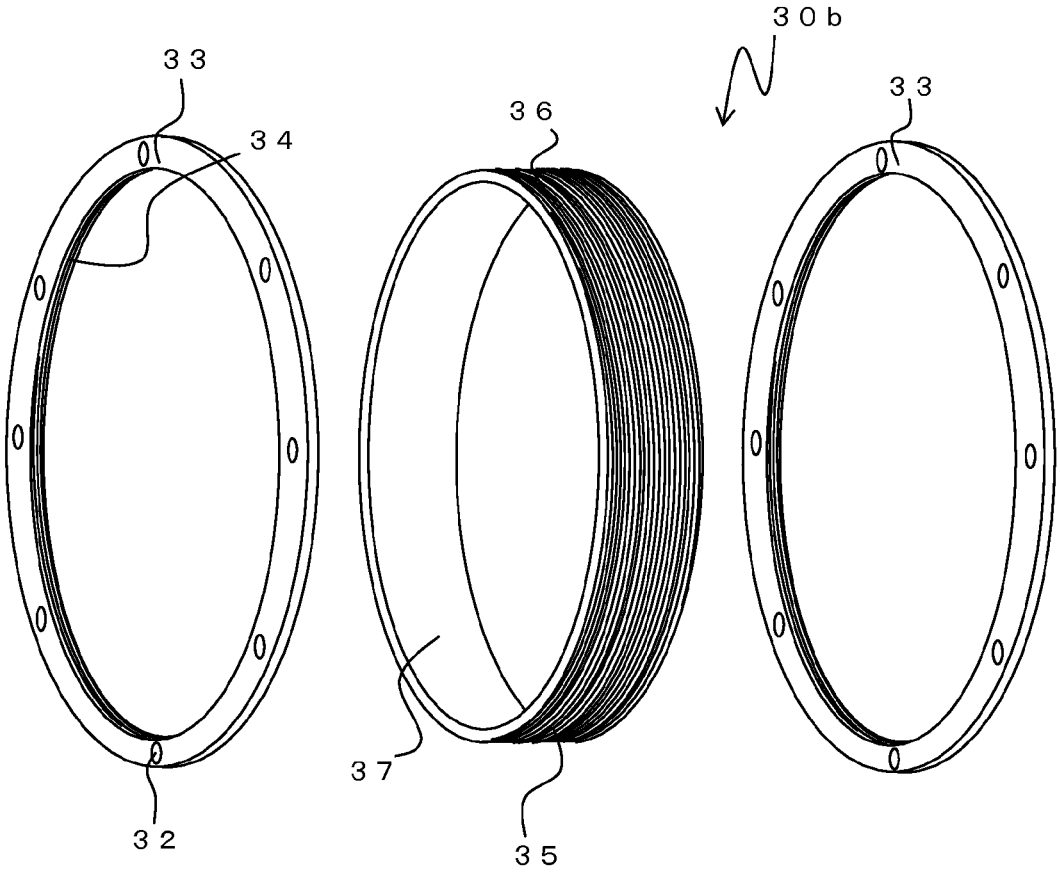
FIG. 13 is a perspective view showing a ring beam reinforcing metallic material 30*b*.

Also, FIG. 13 is a perspective view showing a ring beam reinforcing metallic material 30*b* of a second embodiment. The ring beam reinforcing metallic material 30*b* has the flange 33 and inserting section 35 that are separately formed.

The ring beam reinforcing metallic material 30*b* comprises a pair of the flange 33 and the inserting section 35. The inserting section 35 is cylindrical and has external thread 36 formed on its outer peripheral surface. The flange 33 is ring shaped and has internal thread 34 formed on its internal peripheral surface, which can be screwed to the external thread 36. Also, the flange 33 has welding holes 32 formed on a plurality of locations. The welding holes 32 penetrate the flange 33.

Figure 14:
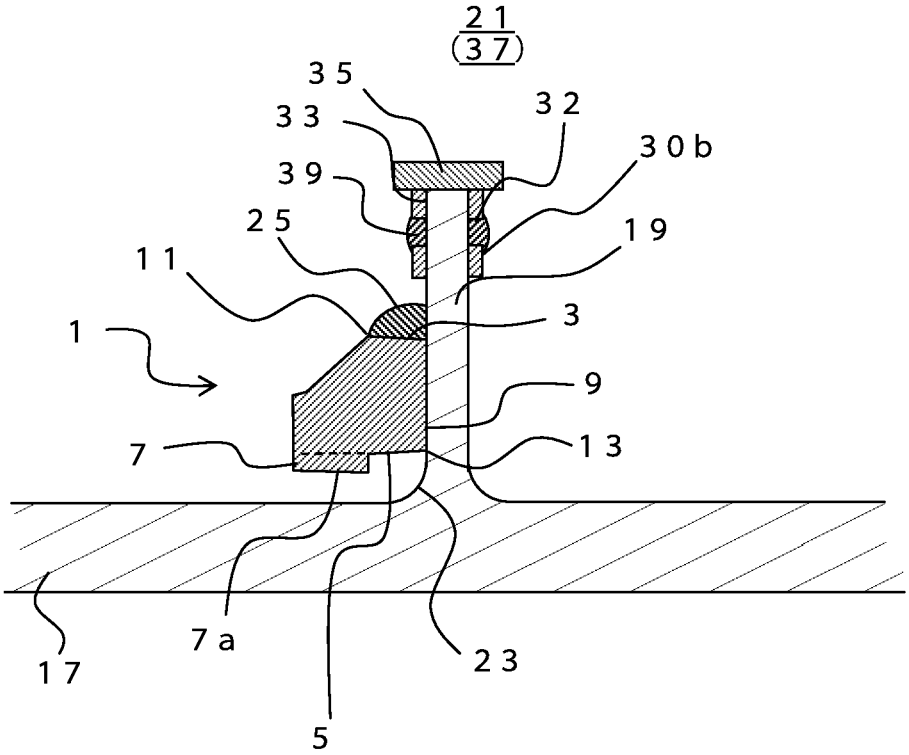
FIG. 14 is a drawing corresponding to FIG. S with the ring beam reinforcing metallic material 30*b*.

FIG. 14 is a cross-sectional view of a beam reinforcing structure using the ring beam reinforcing metallic material 30*b* and corresponds to FIG. 8. The inserting section 35 of the ring beam reinforcing metallic material 30*b* is inserted into the through hole 21. Also, the flanges 33 are fixed from both sides of the inserting section 35 so as to interpose the web part 19. With the web part 19 being interposed by the flanges 33, the web part 19 and the flanges 33 are welded from the welding holes 32. As above, the ring beam reinforcing metallic material 30*b* is fixed to the periphery or the edge part of the through hole 21.

Figure 15:
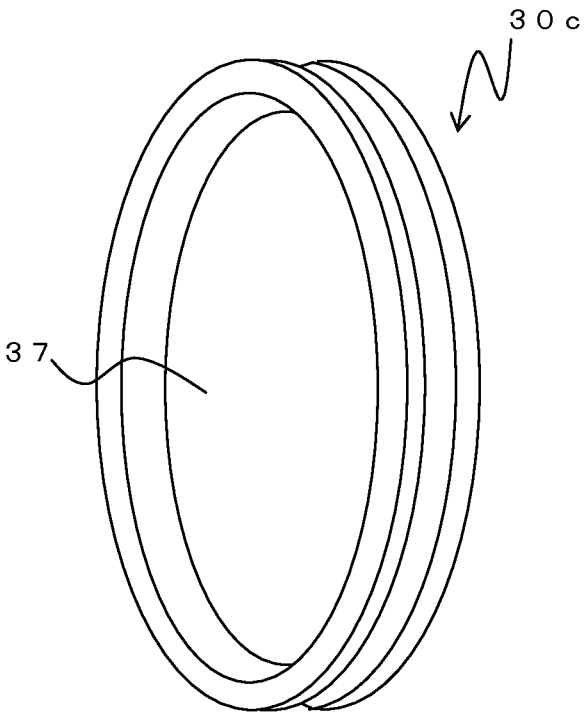
FIG. 15 is a perspective view showing a ring beam reinforcing metallic material 30*c*.

Also, FIG. 15 is a perspective view showing a ring beam reinforcing metallic material 30*c* in a third embodiment. The ring beam reinforcing metallic material 30*c* is a simple cylindrical member and does not have the inserting section nor the flanges.

Figure 16:
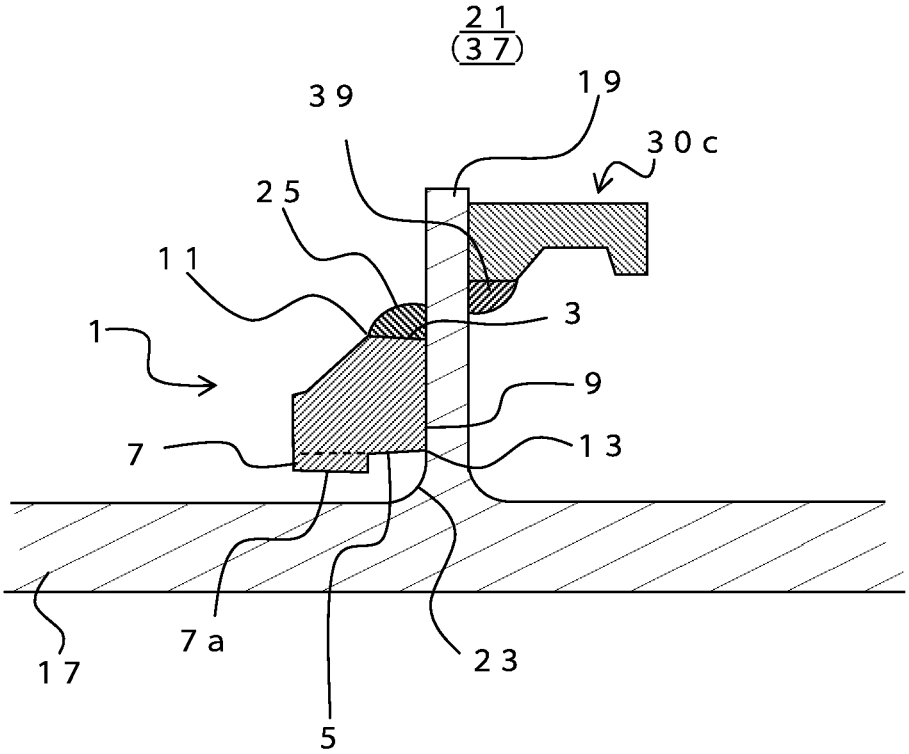
FIG. 16 is a drawing corresponding to FIG. 8 with the ring beam reinforcing metallic material 30*c*.

FIG. 16 is a cross-sectional view of a beam reinforcing structure using the ring beam reinforcing metallic material 30*c* and corresponds to FIG. 8. The ring beam reinforcing metallic material 30*c* is fixed to the back side of the web part 19. That is, the ring beam reinforcing metallic material 30*c* is a member having an inner diameter that is slightly larger than that of the through hole 21 and is not inserted into the through hole 21. The ring beam reinforcing metallic material 30*c* may have an inner diameter that is approximately equivalent to the diameter of the through hole 21. The ring beam reinforcing metallic material 30*c* is welded and fixed to the periphery or the edge part of the through hole 21. As above, a ring beam reinforcing member may be in any form of the embodiments.

WORKING EXAMPLES

Figure 17:
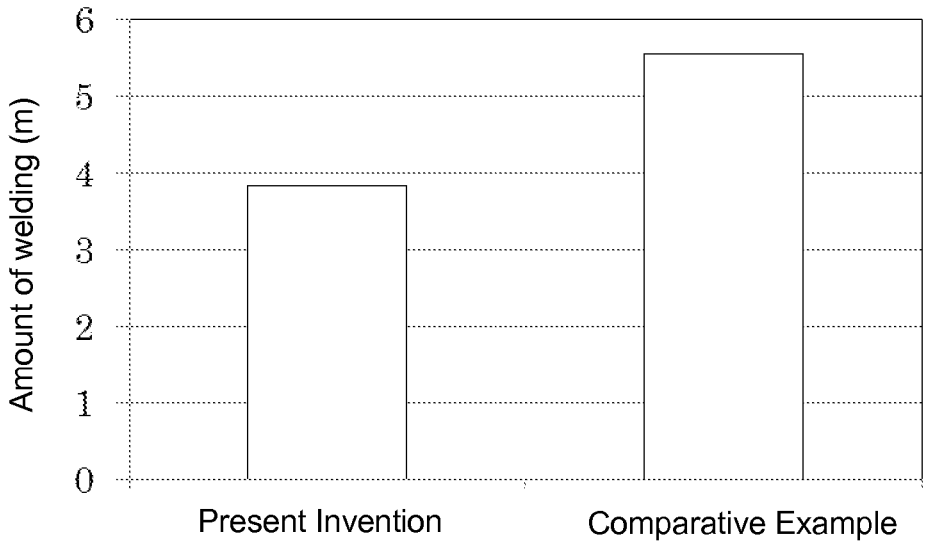
FIG. 17(*a*) shows the difference in the amount of welding between the present invention and a comparative example.
Figure 17:
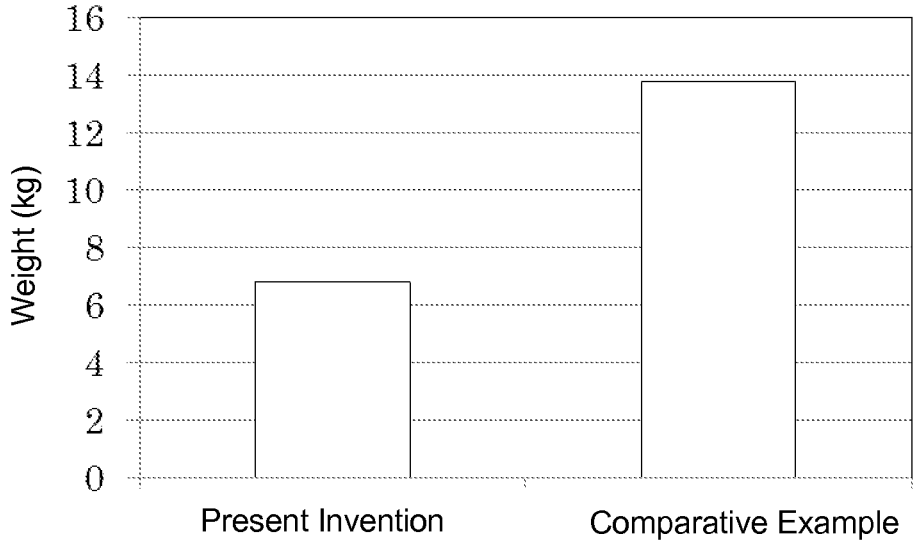

The amount of welding and the weight are compared between a case in which only a ring beam reinforcing metallic material is used and a case in which a ring beam reinforcing metallic material is used together with a beam reinforcing metallic material. The results are shown in FIG. 17(*a*) and FIG. 17(*b*). The hole formed on the beam has a diameter of 350 mm, and a ring beam reinforcing metallic material having a piping hole with an inner diameter of 300 mm is used. The thickness of the web part is 12 mm.

FIG. 17(*a*) compares the total amount of welding in the present invention with the total amount of welding in the comparative example. That is, in the present invention, the total amount of welding is the welding length required to connect the ring beam reinforcing metallic material and the beam reinforcing metallic material to the beam having the same through hole when the minimum of a ring beam reinforcing metallic material and a beam reinforcing metallic material that can improve the required flexural strength are used together. On the other hand, in the comparative example, the total amount of welding is the welding length required to connect the ring beam reinforcing metallic material to the similar beam when the minimum of only a ring beam reinforcing metallic material that can improve the required flexural strength is used. The welding length is converted to the total length of welding in which welding of 6 mm thickness is performed.

Also, FIG. 17(*b*) compares the total weight of the present invention with that of the comparative example. That is, in the present invention, the total weight is the total weight of the ring beam reinforcing metallic material and the beam reinforcing metallic material when the minimum of a ring beam reinforcing metallic material together with a beam reinforcing metallic material that can improve the required flexural strength are used for a beam with the same through hole. On the other hand, in the comparative example, the total weight is the total weight of the ring beam reinforcing metallic material when the minimum of only a ring beam reinforcing metallic material that can improve the required flexural strength is used for a similar beam.

As shown in FIG. 17(*a*), the welding length in the present invention (the welding length of the ring beam reinforcing metallic material: 2.85 m +welding length of the beam reinforcing metallic material: 0.98 m=3.83 m in total) is shorter than the welding length of only the ring beam reinforcing metallic material (5.56 m). This is because a large sized reinforcing metallic material is required when only the ring beam reinforcing metallic material is used and the necessary amount of welding is increased.

Also, as shown in FIG. 17(*b*), the weight of the present invention (weight of the ring beam reinforcing metallic material: 4.8 kg +weight of the beam reinforcing metallic material: 2.0 kg=6.8 kg in total) is less than the weight with only the ring beam reinforcing metallic material (13.8 kg). As above, appropriately disposing a ring beam reinforcing metallic material together with a beam reinforcing metallic material as in the present invention can achieve weight reduction.

Although the embodiments of the present invention have been described referring to the attached drawings, the technical scope of the present invention is not limited to the embodiments described above. It is obvious that persons skilled in the art can think out various examples of changes or modifications within the scope of the technical idea disclosed in the claims, and it will be understood that they naturally belong to the technical scope of the present invention.

For example, the beam reinforcing metallic material 1 and the like may be disposed on the surface of the web 19 that is opposite to the examples of the embodiments shown. That is, although the ring reinforcing metallic material 30, 30*a*, 30*c* that are disposed from the surface of the web part 19 that is on the opposite side of the beam reinforcing metallic material 1 and the like are shown in the examples, the ring reinforcing metallic material 30, 30*a*, 30*c* may also be disposed from the same side of the beam reinforcing metallic material I and the like.

DESCRIPTION OF NOTATIONS

1, 1*a*, 1*b* . . . beam reinforcing metallic material
3 . . . welding surface

3*a* . . . bent section
3*b* . . . welding-range specifying part
5 . . . counter-flange-part surface
7 . . . protrusion
7*a* . . . mark
9 . . . contacting surface
11 . . . angle varying section
13 . . . edge part of the contacting surface
15 . . . beam
17 . . . flange part
19 . . . web part
20 . . . beam reinforcing structure
21 . . . through hole
23 . . . fillet section
25 . . . welded section
30, 30*a*, 30*b*, 30*c* . . . ring beam reinforcing metallic material
32 . . . welding hole
33 . . . flange
34 . . . internal thread
35 . . . inserting section
36 . . . external thread
37 . . . piping hole
39 . . . welding section

What is claimed is:

1. A beam reinforcing structure in which beam reinforcing metallic materials are connected to the beam, comprising:

a beam being an H-shaped metallic material having a web part, flange parts that are above and below the web part, and a through hole formed on the web part;

a ring-shaped first ring beam reinforcing metallic material that is fixed on the periphery or an edge part of the through hole; and a pair of second beam reinforcing metallic materials that are fixed in the vicinity of each of the flange parts of the beam that are above and under the first ring beam reinforcing metallic material, wherein:

both of the second beam reinforcing metallic material having a three-dimensional shape with a longitudinal direction comprise:

a contacting surface that contacts the web part of the beam;

a welding surface that is welded to the web part; and a counter-flange-part surface that faces the flange part of the beam, the cross-sectional area of a center part in the longitudinal direction thereof is larger than each cross-sectional area of both end parts of the second beam reinforcing metallic material in the longitudinal direction thereof, a protrusion that shows the direction of the counter-flange-part surface extends from a side surface of the counter-flange part surface thereof, and a welding-range specifying part that specifies a range of welding is formed on the welding surface, and the welding-range specifying part of the welding surface is welded to the web part.

2. The beam reinforcing structure according to claim 1, wherein the cross-sectional shape of the counter-flange-part surface along the longitudinal direction is approximately in a straight line; and the welding surface is bent or curved and the width of the center part in the longitudinal direction is larger than each width of the both end parts.

3. The beam reinforcing structure according to claim 1, wherein the protrusion is not formed up to the edge part of the contacting surface and a gap is formed between the lower edge of the protrusion and the edge part of the contacting surface so that the tip of the protrusion is in contact with the flange part.

4. The beam reinforcing structure according to claim 1, wherein the protrusion is formed up to the edge part of the contacting surface and the beam reinforcing metallic material is fixed to the position in which the tip of the protrusion is located at the thickness varying part of the web, which is in the vicinity of the border part between the web and the flange part.

5. The beam reinforcing structure according to claim 1, wherein the welding-range specifying part is an angle-varying part formed on the welding surface.

* * * * *